US011386916B2

(12) United States Patent
Markovic et al.

(10) Patent No.: US 11,386,916 B2
(45) Date of Patent: Jul. 12, 2022

(54) SEGMENTATION-BASED FEATURE EXTRACTION FOR ACOUSTIC SCENE CLASSIFICATION

(71) Applicant: Huawei Technologies Co., Ltd., Shenzhen (CN)

(72) Inventors: Milos Markovic, Munich (DE); Florian Eyben, Gilching (DE); Andrea Crespi, Gilching (DE); Björn Schuller, Gilching (DE)

(73) Assignee: Huawei Technologies Co., Ltd., Shenzhen (CN)

( * ) Notice: Subject to any disclaimer, the term of this patent is extended or adjusted under 35 U.S.C. 154(b) by 22 days.

(21) Appl. No.: 16/866,183

(22) Filed: May 4, 2020

(65) Prior Publication Data

US 2020/0265864 A1 Aug. 20, 2020

Related U.S. Application Data

(63) Continuation of application No. PCT/EP2017/078108, filed on Nov. 2, 2017.

(51) Int. Cl.

| | |
|---|---|
| ***G10L 25/51*** | (2013.01) |
| ***G10L 25/18*** | (2013.01) |
| ***G10L 25/21*** | (2013.01) |

(52) U.S. Cl.

CPC ..... *G10L 25/51* (2013.01); *G10L 25/18* (2013.01); *G10L 25/21* (2013.01)

(58) Field of Classification Search

CPC ..... G10L 25/51; G10L 25/18; G10L 25/21; G10L 15/22; G10L 15/30; G10L 15/16;

(Continued)

(56) References Cited

U.S. PATENT DOCUMENTS

2007/0183604 A1* 8/2007 Araki ..... G10L 17/26 381/17
2009/0115635 A1* 5/2009 Berger ..... G10L 25/51 340/943

(Continued)

FOREIGN PATENT DOCUMENTS

| | | |
|---|---|---|
| CN | 1285945 A | 2/2001 |
| EP | 3029673 A1 | 6/2016 |

OTHER PUBLICATIONS

Kyogu Lee et al., "Acoustic scene classification using sparse feature learning and event-based pooling," XP032540830, 2013 IEEE Workshop on Applications of Signal Processing to Audio and Acoustics, total 4 pages, Institute of Electrical and Electronics Engineers, New York, New York (Oct. 20-23, 2013).

(Continued)

*Primary Examiner* — Akelaw Teshale

(74) *Attorney, Agent, or Firm* — Leydig, Voit & Mayer, Ltd.

(57) ABSTRACT

An apparatus and a method for acoustic scene classification of a block of audio samples are provided. The block is partitioned into frames in the time domain. For each respective frame of a plurality of frames of the block, a change measure between the respective frame and a preceding frame of the block is calculated. The respective frame is assigned, based on the calculated change measure, to one of a set of short-event frames, a set of long-event frames, and a set of background frames. The feature vector is determined based on a feature computed from one or more of the set of short-event frames, the set of long-event frames, and the set of background frames.

17 Claims, 7 Drawing Sheets

(58) Field of Classification Search
CPC ..... G10L 15/02; G10L 15/063; G10L 15/197; G10L 2015/0635; G10L 2015/081; G10L 25/24; G10L 13/00; G10L 13/033; G10L 17/00; G10L 17/22; G10L 2015/223; G10L 2021/02166; G10L 13/086; G10L 13/10; G10L 21/0208; G10L 21/038; G10L 25/30; G10L 15/08; G10L 15/1822; G10L 17/26; G10L 2015/088; G10L 25/48; G10L 25/66; G10L 13/08; G10L 15/00; G10L 15/26; G10L 19/00; G10L 15/005; G10L 15/18; G10L 21/02; G10L 21/0232; G10L 21/0272; G10L 25/57; G10L 25/63; H04S 2400/15; H04S 2420/01; H04S 2400/11; H04S 7/304; H04S 3/008; H04S 2400/01; H04S 7/303; H04S 7/307; H04S 7/305; H04S 7/306; H04S 7/301; H04S 7/302; H04S 7/30; H04S 2400/03; H04S 2400/13; H04S 2420/03; H04S 2420/11; H04S 2420/07; H04S 3/00; H04S 3/006; H04S 3/02; H04S 5/00; H04S 7/308; H04S 1/002; H04S 3/002; H04S 3/004; H04S 7/00
See application file for complete search history.

(56) References Cited

U.S. PATENT DOCUMENTS

2011/0313555 A1* 12/2011 Shoham ..... G10L 25/48 700/94
2015/0127710 A1* 5/2015 Ady ..... G10L 19/00 709/202
2016/0377756 A1* 12/2016 Hegna ..... G01V 1/3808 367/24
2017/0061969 A1* 3/2017 Thornburg ..... G10L 25/51

OTHER PUBLICATIONS

Cai et al., "A Flexible Framework for Key Audio Effects Detection and Auditory Context Inference," XP055047442, IEEE Transactions on Audio, Speech, and Language Processing, vol. 14, No. 3, pp. 1026-1039, Institute of Electrical and Electronics Engineers, New York, New York (May 2006).
Dixon, "Onset Detection Revisited," Proceedings of the 9th International Conference on Digital Audio Effects (DAFx-06), pp. 133-137, Montreal, Canada (Sep. 18-20, 2006).
Cotton et al., "Soundtrack Classification by Transient Events," 2011 IEEE International Conference on Acoustics, Speech and Signal Processing (ICASSP), total 4 pages, Institute of Electrical and Electronics Engineers, New York, New York (2011).
J. Nam et al., "Acoustic Scene Classification using Sparse Feature Learning and Selective Max-Pooling by Event Detection," IEEE AASP Challenge on Detection and Classification of Acoustic Scenes and Events, total 3 pages (2013).
Sawhney et al., "Situational Awareness from Environmental Sounds," pp. 1-8 (Jun. 13, 1997).
Heittola et al., "Audio Context Recognition Using Audio Event Histograms," European Signal Processing Conference, total 5 pages, Institute of Electrical and Electronics Engineers, New York, New York (2010).
Lu et al., "Content Analysis for Audio Classification and Segmentation," IEEE Transactions on Speech and Audio Processing, vol. 10, No. 7, pp. 504-516, Institute of Electrical and Electronics Engineers, New York, New York (Oct. 2002).
Barchiesi et al., "Acoustic scene classification: Classifying environments from the sounds they produce," IEEE Signal Processing Magazine, vol. 32, No. 3, pp. 16-34, Institute of Electrical and Electronics Engineers, New York, New York (May 2015).
Chaudhuri et al., "Unsupervised Learning of Acoustic Unit Descriptors for Audio Content Representation and Classification," Interspeech 2011, pp. 2265-2268, ISCA, Florence, Italy (Aug. 28-31, 2011).
Ellis et al., "Minimal-Impact Audio-Based Personal Archives," pp. 39-47 (2004).
Zhang et al., "Audio Content Analysis for Online Audiovisual Data Segmentation and Classification," IEEE Transactions on Speech and Audio Processing, vol. 9, No. 4, pp. 441-457, Institute of Electrical and Electronics Engineers, New York, New York (May 2001).
Kalinli et al., "Saliency-Driven Unstructured Acoustic Scene Classification Using Latent Perceptual Indexing," IEEE International Workshop on Multimedia Signal Processing (MMSP), total 6 pages, Institute of Electrical and Electronics Engineers, New York, New York (Oct. 2009).
Malkin et al., "Classifying User Environment for Mobile Applications using Linear Autoencoding of Ambient Audio," IEEE International Conference on Acoustics, Speech, and Signal Processing (ICASSP 2005), pp. 509-512, Institute of Electrical and Electronics Engineers, New York, New York (2005).
Eronen et al., "Audio-Based Context Recognition," IEEE Transactions on Audio, Speech, and Language Processing, vol. 14, No. 1, pp. 321-329, Institute of Electrical and Electronics Engineers, New York, New York (Jan. 2006).
Roma et al., "Recurrence Quantification Analysis Features for Auditory Scene Classification," IEEE AASP Challenge on Detection and Classification of Acoustic Scenes and Events, total 2 pages, Institute of Electrical and Electronics Engineers, New York, New York (2013).
Geiger et al., "Recognising Acoustic Scenes with Large-Scale Audio Feature Extraction and SVM," IEEE AASP Challenge on Detection and Classification of Acoustic Scenes and Events, total 3 pages (2013).
Cauchi, "Non-Negative Matrix Factorization Applied to Auditory Scenes Classification," total 35 pages (Aug. 2011).
Rakotomamonjy et al., "Histogram of Gradients of Time-Frequency Representations for Audio Scene Classification," IEEE/ACM Transactions on Audio, Speech, and Language Processing, vol. 23, No. 1, pp. 142-153. (Jan. 2015).

* cited by examiner

SEGMENTATION-BASED FEATURE EXTRACTION FOR ACOUSTIC SCENE CLASSIFICATION

CROSS-REFERENCE TO RELATED APPLICATIONS

This application is a continuation of International Application No. PCT/EP2017/078108, filed on Nov. 2, 2017, the disclosure of which is hereby incorporated by reference in its entirety.

TECHNICAL FIELD

The present disclosure relates to audio processing and, in particular, to feature extraction from audio signals, which may be used, for instance, in applications employing acoustic scene classification.

BACKGROUND

Acoustic Scene Classification (ASC) refers to a technology by which a type of the environment, for example, of a car, office, street, restaurant, or the like, is identified solely based on the sound recorded at those environments. In particular, each environment is characterized in terms of sound events that occur at that environment or are produced by the environment itself.

The salient approach of environmental identification consists in associating acoustic fingerprints, which are characteristic of the environment, with semantic labels. For this purpose, a feature vector can be derived first based on a training set of acoustic scenes with a known class (label). The feature vector can then be used to train a statistical model (S-Model) for the respective class associated with the feature vector. Such a trained S-Model in its essence encompasses the properties of the environmental acoustic landscape belonging to the same category (class). After this learning phase (training), other not yet labeled acoustic recordings are associated with the categories that best match their respective feature vectors.

In general, the ASC process can be divided into a training and a classification phase, as illustrated by the example in FIG. 1 and FIG. 2. FIG. 1 exemplifies the various stages of the training phase. An audio recording database 110 stores various recordings of audio signals, corresponding to known scenes with the respective scene labels. For a known recording, the feature extraction 120 may be performed. The obtained feature vector and the respective label of the known scene are then provided for the training 130. The result of this training are scene models 140 on the basis of the known audio recordings from the database 110. In turn, the result of the classification 230 consists in the scene identification 250 by feature extraction 220 from unknown audio recordings 210, based on the known scene models 240 which is a result of the training 130.

In the example illustrated in FIG. 1, a training phase involves an estimation of scene models by suitable classifiers, such as support vector machine (SVM), Gaussian-Mixture-Model (GMM), neural networks or the like. One of these classifiers is used for the training stage 130. The training stage generates learned scene models 140, based on the input from the feature extraction stage 120, with audio features extracted from known recordings of the audio recording database 110.

FIG. 2 exemplifies a classification phase. In the example, an audio recording 210 is input for being classified. In stage

220, corresponding to stage 120 of the training phase, the feature vector is determined from the input audio recording 210. The actual classification 230, is performed according to the scene model(s) 240, which corresponds to the scene model(s) derived in stage 140. The classifier 230 then outputs the recognized class of audio scene 250 for the input audio recording 210.

In other words, in the classification phase, shown in FIG. 2, the same features are extracted in stage 220 now from unknown audio samples 210 based on the known (i.e., learned) scene models 240. These two basic inputs are used to classify 230 the acoustic scene 250 in terms of the trained acoustic scenes, as represented by the scene models 240.

An important part of ASC is to define and extract from the audio signal those properties that are thought to be characteristic of a certain environment in terms of its audio features. To this end, ASC systems have been exploiting various audio feature categories, largely borrowed from those commonly used in speech analysis and auditory research. Those categories are, for example, based on one or more of the following:

- Low-level time and frequency based features, such as zero crossing rate or spectral centroid of the audio signal,
- Frequency-band energy features, measuring the amount of energy present within different sub-bands of the audio signal,
- Auditory filter banks, where the filter banks are used to mimic the response of the human auditory system for the analysis of the audio frames,
- Cepstral features based on Mel-frequency cepstral coefficients (MFCCs) for capturing the spectral envelope of a sound,
- Spatial features for multichannel recordings, such as interaural time or level difference,
- Voicing features, based on fundamental frequency estimation,
- Linear predictor coefficients, based on autoregressive model,
- Unsupervised learning features, wherein the basic properties of an audio signal are adaptively encoded, i.e., features are learnt iteratively according to certain criteria,
- Matrix factorization method, by which the spectrogram of an acoustic signal is described as a linear combination of elementary functions,
- Image processing features, extracted from the image of the constant-Q transform of audio signals, and
- Event detection, based on a histogram of events, such as dog barking, passing by of a car, gun shot, glass brake, detected in an audio signal. In general, event is any part of audio signal which has a different energy (e.g. RMS) than the rest of the signal.

Several ASC approaches are known. For instance, a method proposed in "J. NAM, Z. HYUNG and K. LEE. Acoustic scene classification using sparse feature learning and selective max-pooling by event detection. IEEE AASP Challenge on Detection and Classification of Acoustic Scenes and Events. 2013" applies a sparse-feature learning approach to ASC. This method is based on a sparse restricted Boltzmann machine and suggests a new scheme to merge features. This scheme first detects audio events and then performs pooling only over detected events, considering the irregular occurrence of audio events in acoustic scene data. Events are detected by thresholding the mean feature activation of local hidden units. The target features used in this context are the MFCCs.

Document "COTTON, COURTENAY V., et al. "Soundtrack classification by transient events", Acoustics, Speech and Signal Processing (ICASSP), 2011 IEEE International Conference on. IEEE, 2011" presents a method for video classification based on soundtrack analysis. The authors investigate an approach that focuses on audio transients corresponding to acoustic events. The resulting event-related features are expected to reflect the "foreground" of the soundtrack and capture its short-term temporal structure better than conventional frame-based statistics. Events are detected by tracking the evolution in time of each channel of a magnitude short-time Fourier transform (STFT) representation of the input signal, and by comparing these values to a threshold based on their local (temporal) mean.

A variety of techniques already exists for event identification and may be incorporated into an ASC scheme in order to improve the performance of a sound classifier. While in strongly constrained classification scenarios, the identification of certain events can indeed help to characterize the general environment, these methods yet suffer from a couple of drawbacks in a real environment, such as:

1. The sound events need to be defined and selected manually.
2. The large number of sound events in a real environment, making it an unrealistic task to define, select, and recognize (classify) all of them.
3. The difficulty to ensure that some sound events must emerge in a specific acoustic environment and some sound events can also be heard in different acoustic environments.

Thus, techniques based on audio event detection (AED) are not directly applicable to softly constrained ASC problems, since the set of acoustic events characterizing a specific environment is generally unbounded and extremely difficult to generalize.

SUMMARY OF THE INVENTION

In view of the above mentioned problems, rather than identifying specific events, the present disclosure identifies generic event types. The present disclosure is based on an observation that features extracted on the basis of three event classes, namely short event, long-event, and background, may provide distinct statistics when the acoustic scenes are different.

Accordingly, the technique disclosed herein can improve the feature extraction stage and thus improve the acoustic scene classification.

According to one embodiment, an apparatus is provided for acoustic scene classification of a block of audio samples. The apparatus comprises a processing circuitry configured to partition the block into frames in the time domain; for each frame of a plurality of frames of the block, calculate a change measure between the frame and a preceding frame of the block; assign the frame to one of a set of short-event frames, a set of long-event frames, or a set of background frames, based on the respective calculated change measure; and determine a feature vector of the block based on a feature computed from the set of short-event frames, the set of long-event frames, and the set of background frames. The preceding frame may be the immediate predecessor of the respective frame; this can make the method particularly reliable. In one embodiment, the assignment of the frame to one of the set of short-event frames, the set of long-event frames, or the set of background frames is based on a plurality (e.g., two) change measures, each of the change measures measuring a change of the respective frame relative to a respective preceding frame (e.g., the first N frames preceding the frame in question may be used to evaluate the change measure, N≥2). The change measure between two frames may be computed on the basis of a spectral representation of the two respective frames. In one embodiment, the plurality of frames comprises all frames of the block except the first (i.e. earliest) frame of the block (the first frame of the block lacking a preceding frame in the block).

The processing circuitry is further configured to determine the set of short-event frames, including high-pass filtering of the change measure values calculated for a plurality of respective frames; detecting peaks in the high-pass filtered change measure, based on a first predetermined threshold; and assigning the frames, in which the peaks are detected, to the set of short-event frames.

The processing circuitry is further configured to determine the set of long-event frames, including low-pass filtering of the change measure values; detecting peaks in the low-pass filtered change measure, based on a second predetermined threshold; and assigning the frames, in which the peaks are detected, to the set of long-event frames.

According to an embodiment, the processing circuitry is configured to expand the set of long-event frames by adding frames around a peak detected in the low-pass filtered change measure corresponding to a long-event region, based on peak height PH of the detected peak, a first difference $g_1$ between the peak height and a first valley in the low-pass filtered change measure preceding the peak, and/or a second difference $g_2$ between the peak height and a second valley following the peak, and a threshold T.

The apparatus, including the processing circuitry is configured to update the threshold T based on the peak height of the long-event peak and the minimum of $g_1$ and $g_2$, as follows:

$$T=\mathrm{PH}-\min(g_1,g_2).$$

The apparatus further expands the long-event region on a frame-basis from the long-event peak in a direction of preceding frames and/or in a direction of following frames, by adding the corresponding frame to the set of long-event frames, until the change measure of the frame is lower than the threshold T; and removing the frame from the set of long-event frames corresponding to the long-event region, if the frame is both a long-event and a short event frame.

According to an embodiment, the processing circuitry is configured to determine the set of background frames as those frames that are neither short-event frames nor long-event frames.

According to an embodiment, the processing circuitry uses complex domain difference as the change measure.

According to an embodiment, the processing circuitry calculates the feature according to at least one of an event-related feature, including event score, event count, activity level, and event statistics.

According to an embodiment, the processing circuitry calculates the feature according to at least one of a frame-related feature, including spectral coefficients, power, power spectral peak, and harmonicity.

According to an embodiment, the frames of the block are overlapping.

According to an embodiment, the processing circuitry transforms the frame by multiplying the frame by a windowing function and Fourier transform.

According to an embodiment, the processing circuitry classifies the acoustic scene based on the feature vector, comprising the frame-related features and the event-related features extracted for each set of the short-event frames, the long-event frames, and the background frames, and on features extracted for all the frames of the block.

According to an embodiment, a method is provided for acoustic scene classification of a block of audio samples, by partitioning the block into frames in the time domain; for each frame of a plurality of frames of the block, calculating a change measure between the frame and a preceding frame; assigning the frame to one of a set of short-event frames, a set of long-event frames, or a set of background frames, based on the respective calculated change measure; and determining a feature vector based on a feature computed from the set of short-event frames, the set of long-event frames, and the set of background frames.

According to an embodiment, a computer readable medium is provided for storing instructions, which when executed on a processor cause the processor to perform the above method.

BRIEF DESCRIPTION OF THE DRAWINGS

In the following, exemplary embodiments are described in more detail with reference to the attached figures and drawings, in which.

DETAILED DESCRIPTION

Figure 1:
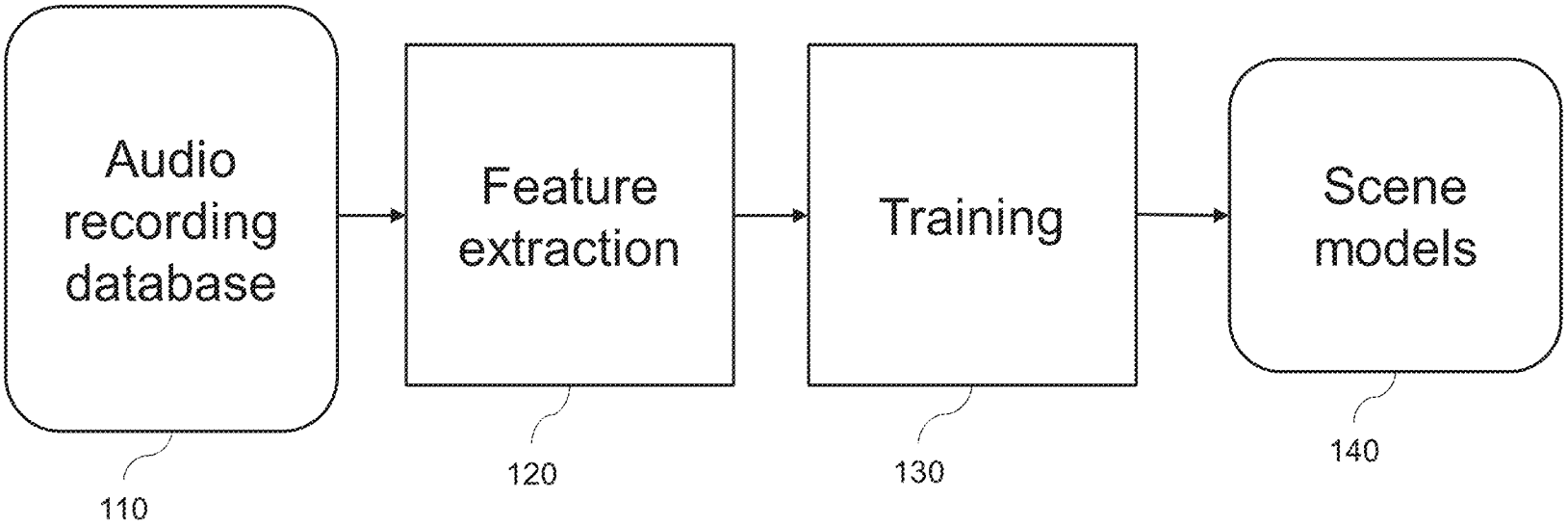
FIG. 1 is a schematic drawing of an example of a build-up of acoustic scene models via training based on feature extraction from an audio recording database.

The present disclosure relates to the general field of audio signal processing. In particular, the disclosure relates to machine-learning-based methods (including deep learning methods) for acoustic scene analysis applications like acoustic scene identification, acoustic scene classification (ASC) etc. Possible application of the present disclosure is in environment-aware services for smart phones/tablets or smart wearable devices and, thus, enable an assessment of their environment, based on an in-depth analysis of the sound characteristics of the scenes.

More specifically, the present disclosure relates to feature extraction from audio signals, the features characterizing specific environments. The extracted features can be used to categorize audio recordings of various environments into different classes. Improvement of feature extraction can result in a higher accuracy or robustness of, e.g., acoustic scene classification.

The present disclosure describes a technique for extracting audio features (e.g., for ASC). The technique comprises segmenting an audio signal into three types of segments (also referred to herein as event classes): long audio events, short audio events, and background. This segmenting enables a further analysis of the contribution of each type of segment. The scene identification may be based on low-level audio features, which are aggregated (e.g., by feature averaging) over each respective event type. Alternatively or in addition, the scene identification may be based on new features, referred to as event-related features, and based on the evaluation of the events of a certain type (one segment), for instance, statistically (e.g., number of events of certain type in a predetermined time, ratio between number of events of certain types, number of frames of certain event type, or the like). The technique thus improves separation of different acoustic scenes according to both a high level (semantic) meaning and to specific attributes which characterize a scene, e.g., in terms of activity, brightness, harmonicity etc.

The proposed splitting into the three types of segments is performed with the aim of chopping the analyzed acoustic scene into three basic "layers" corresponding to the event classes. These classes are found by detecting and distinguishing both short events and long events, while the remainder of the signal is attributed to the background. The partitioning of the scene into three event classes provides additional information through new features, which can be subject to further classification.

Such acoustic signatures related to short and long events are salient acoustic signatures. In the present technique, these acoustic signatures are used to provide a reliable and improved classification of acoustic scenes, as they contain important information on the dynamics and duration of acoustic events within (in all or in parts of) audio recordings.

Therefore, the proposed feature definition and extraction of the present disclosure makes identification and classification of acoustic scenes more effective, based on features determined by splitting the audio input signal into such three sets of frames and by extracting separately desired descriptors on each selection of frames rather than on all frames indiscriminately. Such a scheme allows further the definition of novel features, which can be added to an extended feature vector. The feature extraction 120 in FIG. 1, respectively, 220 in FIG. 2 extracts features on the basis of the improved feature vector for the training 130 and classification 230. In this way, the learned scene models 140 are improved and, hence, the scene recognition 250 becomes more accurate.

In particular, in the present disclosure, an improved type of feature definition and extraction is provided and used, for example, in an acoustic scene classifier. These features are extracted from audio portions, resulting from a segmentation process that is run on an input audio signal to be classified.

In one embodiment, a processing circuitry is provided, which is configured to partition a block of audio signal into frames.

The block of audio signal may be, for instance, a portion of an audio signal having a predefined length (for example set by a user) or may be the entire audio signal to be classified. It includes audio samples in the temporal domain, e.g., samples of the audio signal obtained at certain sampling interval(s). The samples may form a sequence of analog or digital values. The specific values for the sampling rate, digitalization/quantization type, and step size are immaterial for the present disclosure and may be set to any value. The size of the frame is lower than the size of the block. For example, the portion of the audio signal, corresponding to an audio block, may have a typical length of 5-30 s and split into 1024 audio samples, in which case the length of the frame is about 5-30 ms. In general, a frame is a sequence of K samples, i.e., digital values, with K being an integer larger than 1 and smaller than the number of samples in the block.

The processing circuitry further transforms a frame of samples into a respective frame of spectral coefficients. This transformation may be performed for each frame of the block. However, the present disclosure is not limited thereto and, in general, some frames may be left out from the analysis. It is noted that the block segmentation and the transformation steps may be left out in a case, in which already transformed frames are provided as an input to the processing circuitry. For example, the transformed frames may be read out from a storage. Such an approach may be beneficial, for example, if pre-processed transformed frames are used to compress an audio signal and, thus, the audio signal is already stored in a compressed form.

The processing circuitry then calculates for the frame a change measure between the frame of spectral coefficients and at least one of its preceding adjacent frame. The change measure is a measure for how much the audio content within a block changes by comparing the audio spectrum of a current frame with the audio spectrum of at least one of a preceding frame. Note that the change measure may extend over multiple preceding frames. For example, such change measure may be a difference between the spectrum of the present frame and a weighted spectra of m previous frames, m being an integer larger than 1. The weights may advantageously lower with growing distance between the weighted frame and the present frame. Such measure may better capture self-similarity of the audio signal within an audio block on a frame-basis. However, a simple difference (or its absolute value) between the spectrum of the present frame and its preceding frame provides for good results. The spectrum of frame in this context may be represented by a metric applied to the spectral coefficients of the frame to obtain a single value such as mean, variance, weighted average, or the like. On the other hand, the difference may also be calculated between the respective spectral coefficients of the two frames (present and immediately preceding) and summed or averaged, or a correlation between the spectra of the two frames may be calculated. In other words, the present disclosure is not limited to any particular change measure.

Furthermore, the processing circuitry assigns the frame to one of a set of short-event frames, a set of long-event frames, and a set of background frames, based on the respective calculated change measure and determines the feature vector based on a feature computed from the set of short-event frames, the set of long-event frames, and the set of background frames.

The above described frame assignment to one of the short-event frames, long-event frames or background may be performed for each frame of the audio signal block. This results in subdividing the entire audio block into three segments or layers for which later some features may be aggregated to become part of the feature vector. However, the present disclosure is not limited to performing of the assignment for each and every frame. For various reasons (e.g. complexity reduction or anything else), only a subset of frames may be assigned one of the three above mentioned category. Moreover, the approach of the frame categorization may be extended to include more than three classes of events (segments).

In other words, the present disclosure defines and extracts features (entailed in a feature vector) by applying long-event and short-event functions to segment an audio signal, by which three parts of the audio signal are provided, namely long-event, short-event, and background segment. Low-level features, extracted on a frame level, are aggregated, for example, via statistical functions (e.g. mean calculation) over each of the obtained segments. In addition, new features enabled by the segmentation process are defined and implemented (event-related features). Combination of the two types of features contributes to a better discrimination between acoustic scene classes.

The term "short-event" here refers to events occurring within the duration of approximately one frame, such as gun shot, door slam, or finger snap and the like. However, it is noted that the disclosure is not limited thereto and a short-event may also be detected for a predetermined number of frames.

The term "long-event" here refers to events, which are longer than the short events, i.e., are not short events, such as passing by of a car and/or train, phone ringing, or dog barking, and the like. These kinds of events are identified by the amount of change in the audio signal and/or its spectrum over certain period.

The term "background" refers to audio signals, which do not include short or long events. However, the present disclosure is not limited to such definition of background. Background frames may be defined as those frames, in which the audio change to the preceding frame(s) remains below certain threshold. In case there are more than three categories, the background frames may also be defined as the frames, which do not belong to any of the other categories.

In one embodiment, the segmentation process labels the input frames into three different layers, namely short acoustic events, long acoustic events, and background acoustic events according to the detected properties of audio events within the acoustic scene.

Such audio feature extraction is particularly suitable for ASC, which may be employed in variety of different applications. For example, an encoder and decoder for audio signals may make use of audio scene classification in order to differently compress certain scenes.

Another application of the present disclosure is phone-based ASC, wherein the phone recognizes the environment in which it is located and, based on the location, sets up a different ringing mode, such as the ringing volume (silent or loud), a specific ringing sound or the like. For instance, in louder or event-rich environments, the ringing tone may be set louder than in silent or event-poor environment.

Another application of the present disclosure is in smart headphones, which recognize the acoustic environment (e.g. a street) and turn on the hear-through mode automatically, for instance while the user is running in the park.

Further, the present disclosure may be applied in environment-aware services for smart phones/tablets or smart wearable devices. It contributes to enabling devices to make sense of their environment through in-depth analysis of the sounds of the scenes.

Moreover, ASC may be used for possibly context-based speech recognition and speech control for instance in intelligent assistant services. Another use case may be the recognition of certain scenes, which automatically control, for instance, alarm triggering or monitoring/surveillance cameras.

Figure 2:
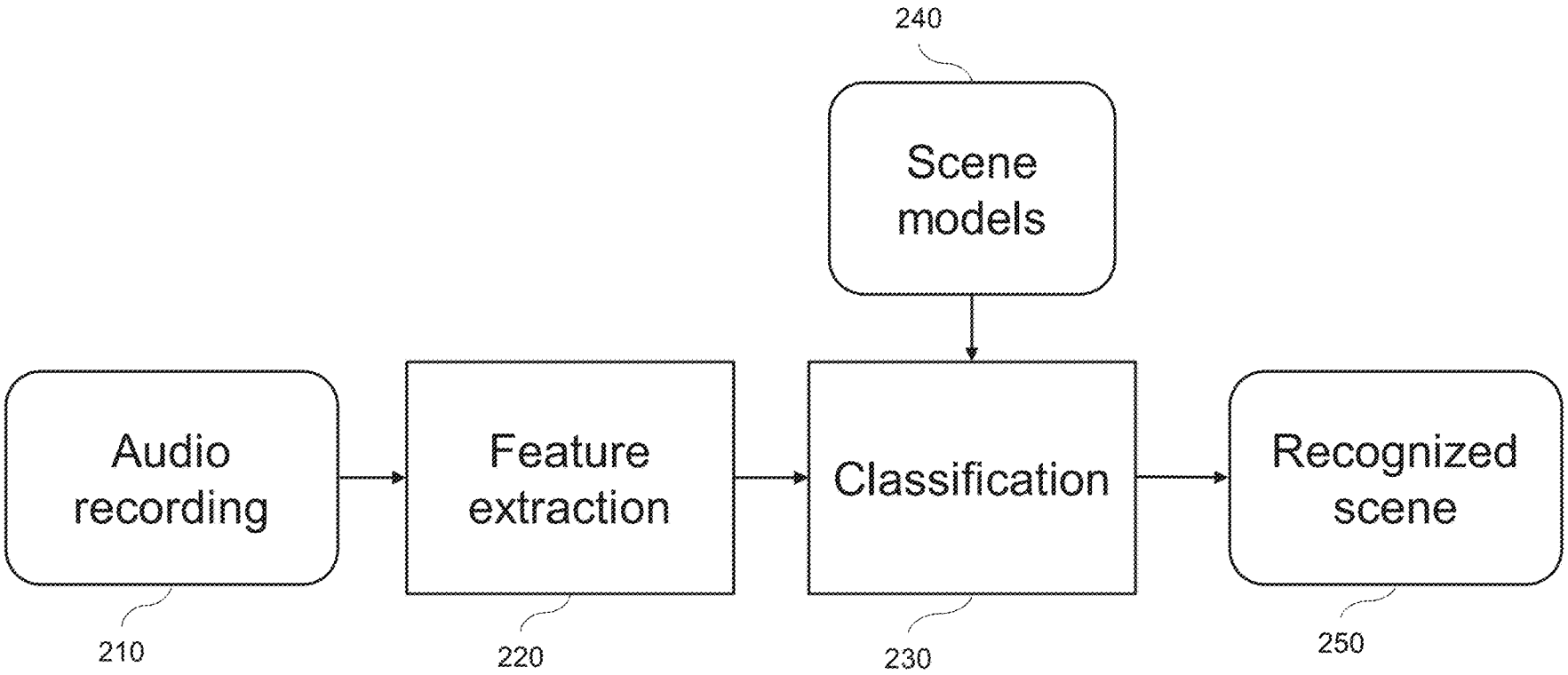
FIG. 2 is a schematic drawing of an example of scene recognition by feature extraction from an actual audio recording, based on the trained scene models.

In general, the process of acoustic scene classification (ASC) can be divided into a training and classification phase, as illustrated in FIG. 1 and FIG. 2.

FIG. 1 illustrates the training phase, in which scene models are learned. Using an audio recording database, a set of known features (a feature vector) are extracted from the audio recording samples. The features may include features calculated based on the above described short-event, long-event, and/or background frames. The feature vector together with a known, desired result of the classification is then used as input to improve or estimate the parameters of a classifier, i.e. by training the classifier. The classifier may, for example, be a support vector machine (SVM), a Gaussian-Mixture model (GMM), a neural network, or the like.

FIG. 2 illustrates the classification phase, in which the same feature vector is extracted, but now from unknown (not yet classified) audio recording samples. The feature vector is input to the classifier trained as shown in FIG. 1, i.e. implementing the model obtained by training with the audio recording samples with known classification result. The classifier then recognizes (classifies) the input acoustic scene, i.e. it assigns the input acoustic scene a class. For instance, an audio scene (e.g., an audio block mentioned above) may be classified as a railway station or a shopping mall or a highway, or the like. One of the benefits of the ASC based on the above described short-event/long-event/background segmentation is that detection of particular specific events that are characteristic of certain environments is not necessary. This provides an easier scalability and adaption of the approach for new kinds of environments. The classification based on feature vectors calculated based on measures computed only over frames of the same category on the one hand allows characterizing different events and thus mapping such characterization on different respective environments/acoustic scenes. On the other hand, the frame categorization to long-events, short-events and background is based on general event features such as event duration and intensity, rather than on recognition of particular audio sounds expected in certain environments (such as sound of breaking wheels at railway station or sound of water at a sea or the like).

Figure 3:
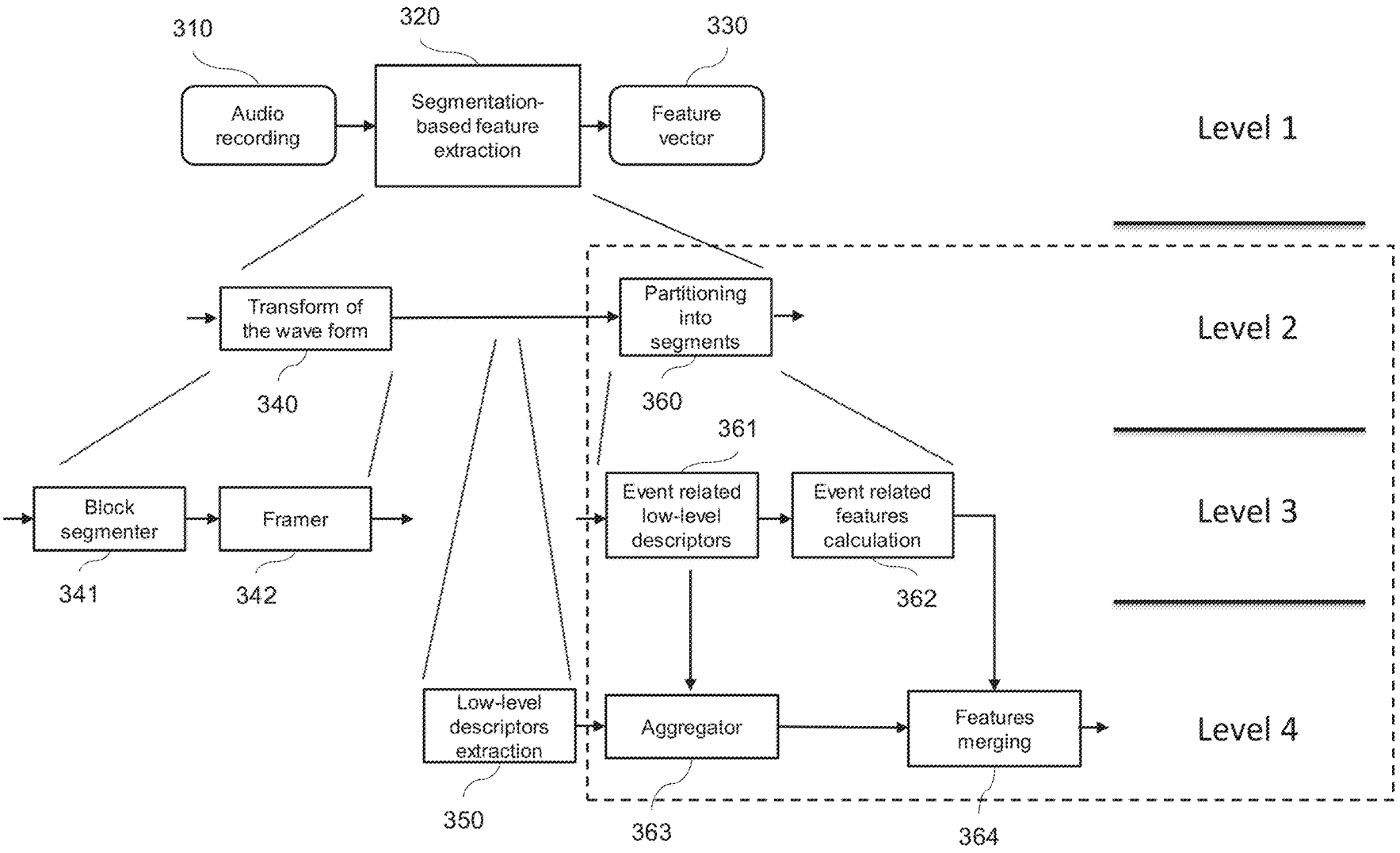
FIG. 3 is a hierarchical sketch showing an example of four levels of the procedure of the segmentation of the audio recording according to event-related features.

FIG. 3 shows a top-down view of an example of the technique disclosed herein. The technique is described in terms of four levels as follows:

Level 1: On the first level, a general representation of an apparatus is shown to determine a feature vector 330 (output) from an audio recording 310 (input) through a segmentation-based feature extraction 320, applying the above described approach.

Level 2: On the second level, the segmentation-based feature extraction is sub-divided further into two functional blocks, where the incoming audio recording is split first into a suitable frame-based representation by transform of the audio waveform 340. This is followed by a partitioning 360 of the frame-based audio signal into three basic segments (corresponding to event classes), namely a short-event, long-event, and a background-event layer. The core of the present disclosure is exploiting the three distinct segments (event layers) for the detection of typical features to distinguish between different types of acoustic scenes.

Level 3: On the third level, the audio wave form is transformed into block portions by a block segmenter 341, with each block being partitioned into an overlapping frame representation by a framer 342. The block segmentation of the audio signal is performed, for instance, through windowing functions such as rectangular windows with the duration of a block. However, the present disclosure is not limited by this example. The blocks of the audio recording may also be overlapping. On the other hand, the frames may be non-overlapping. Overlapping in frame level may provide for higher smoothness of the change measure to be calculated.

The audio wave form may be for instance an already sampled and digitalized audio signal, i.e. a sequence of audio samples. However, the present disclosure is not limited thereto and an apparatus of an embodiment may also include digitalization unit (sampling and analog-to-digital conversion). The present disclosure may also work on analog signals, which—however—is less practical than the operation with digital signals.

After the transformed audio is segmented into the three types of layers, low-level features on the basis of low-level descriptors (LLD) for each layer are extracted 361 as well as features according to event-related features are calculated 362.

Level 4: On the fourth level, an aggregator 363 performs the statistical aggregation of the extracted frame-based LLDs 350 per layer (type of the event). The aggregated features are combined with the calculated event-related features 362 by the features merging 364 into a feature vector 330 as output.

An advantage of this approach is that supplementary information is provided about the, e.g., occurrence of short and/or long events. This information may be used as additional input features in conjunction with the layer-based features in order to classify acoustic scenes in accordance with their short-acoustic, long-acoustic, and background-acoustic fingerprints.

A further advantage of the approach is that novel features are introduced by the three-layer based segmentation, which can be added to the previously extracted LLDs. In this way, an extended final feature vector (joint feature vector) can be obtained to classify audio scenes.

Figure 4:
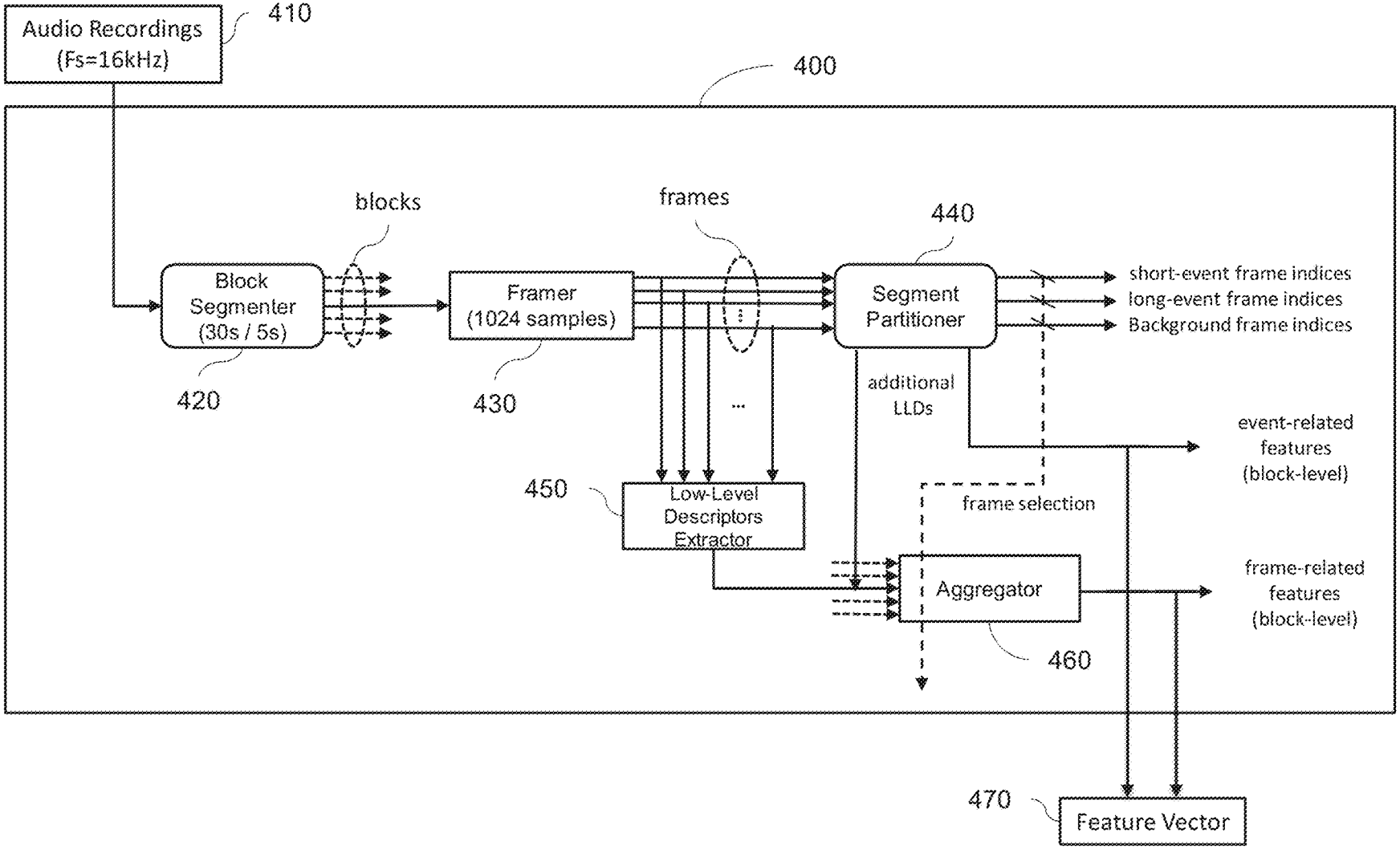
FIG. 4 is a schematic drawing illustrating an example of a build-up of a joint feature vector by combining frame-related low-level descriptors (LLDs) with event-related LLDs, utilizing the segment partitioning method.

FIG. 4 shows a possible embodiment of a joint-feature extractor 400. An input signal, such as an audio recording 410, is split into a set of non-overlapping audio blocks of equal length by the block segmenter 420, with the block length being on the order of a few tens of seconds, for example. The result is a number of non-overlapping audio blocks with a length of, e.g., of 30 s. In the example of FIG. 4, the sampling frequency Fs is equal to 16 kHz, meaning 16000 samples per second.

According to another embodiment of the technique, the audio recording may be split into non-equal length audio blocks. Such approach may be useful, for instance, if the audio recording contains different audio scenes with respective different durations, at least approximately known beforehand.

According to an embodiment of the technique, the frame and/or block segmentation of the audio signal is performed using a windowing function, such as a Hann window. Other windowing functions may be used alternatively, including Hamming, confined Gaussian, Welch, Sine, and the like suitable to perform the windowing.

Each audio block is then divided by a framer 430 into N overlapping frames of equal length. The framed block may consist of a few hundreds of samples, for example. For example, with an audio block having a typical length of 5-30 s and split into frames with the length of 1024 audio samples, the length of the frame is about 64 ms. The frame-based defined audio is used in the further steps of the processing chain, as described in the following.

The set of overlapping frames of one audio block are the input for the low-level descriptor (LLD) extractor 450 and the segment partitioner 440.

The low-level descriptor extractor 450 extracts from each frame one or more typical LLDs. Possible LLDs are provided (but not limited to) in D. Barchiesi, D. Giannoulis, D. Stowell, and M. D. Plumbley, "Acoustic scene classification: Classifying environments from the sounds they produce," IEEE Signal Processing Magazine, vol. 32, no. 3, pp. 16-34, 2015, for example:

- spectral peak frequency and/or spectral peak value,
- Hammarberg index (defined as the difference between the maximum energy in the 0 . . . 2 kHz and in the 2 . . . 5 kHz band),
- alpha ratio (defined as the energy ratio calculated between a low (e.g., 0.5-1 kHz) and high frequency range (1-5 kHz)),
- harmonicity measure (such as ratio of harmonic power to total power or upper frequency beyond which the spectrum is not harmonic, or the like),
- spectral flatness,
- power,
- spectral centroid, or the like.

In other words, for each frame, one or more of the above LLDs is determined (calculated).

The segment partitioner 440, the details of which are described further below, performs detection of the short events and long events by calculating function values of short-event and long-event detection functions from the input frames of one audio block. These input frames are thus assigned a category according to their affiliation to short events, long events, and background. The segment partitioner produces, the frame indices related to short events, long events, and background, respectively. The partitioner 440 may also output one or more event-related features such as number of frames pertaining to short-event layer, number of frames pertaining to long-event layer, number of frames pertaining to background layer or number of short-term events and/or number of long-term events.

An advantage of assigning of each frame into one of the three layers short event, long event, and background is that both frame-related features aggregated per layer and event-related features may be obtained, in addition to the known frame-based LLDs which do not distinguish between frames of different event types. For instance, the frame related feature spectral flatness may be calculated as a median of spectral flatness of all frames in the block which pertain to one segment (layer), for instance, to long-term events. The present disclosure does not limit the feature vector to including only frame-related features for a single layer. The feature vector may further include frame-related features which are calculated over frames of all layers. Moreover, combined features may be provided, such as ratio or difference between frame-related features calculated over frames of a single layer and frame-related features calculated over frames of all layers. Other possibility is to introduce a feature which is a weighted average of frame-related features calculated over respective different layers.

The calculation of the frame-related features is performed in the aggregator 460. In the example, the aggregator 460 obtains on its input the indices of frames assigned to the respective layers and implements the calculation of one or more various aggregators, for example, mean, median, standard deviation, minimum, maximum, range, and the like as described above. The result of this aggregation is a respective frame-related feature based on frames of a single audio block or more such features. Moreover, the aggregation may also provide aggregation of additional features such as minimum, maximum, mean or other of the aggregation functions of the long-term event length in number of frames. Correspondingly aggregation of other layer's features may be performed.

The frame-related features, determined by the aggregator 460, and/or the event-related features, determined by the segment partitioner 440, and/or features calculated by the aggregator 460 over the entire block, are then combined into a feature vector 470 for the audio block.

This extended feature vector 470 is used in the feature extraction stage 120 and 220 in the training and classification phase in order to provide improved scene models 140, respectively, to recognize the scene 250 based on the (trained) scene models 240.

Figure 5:
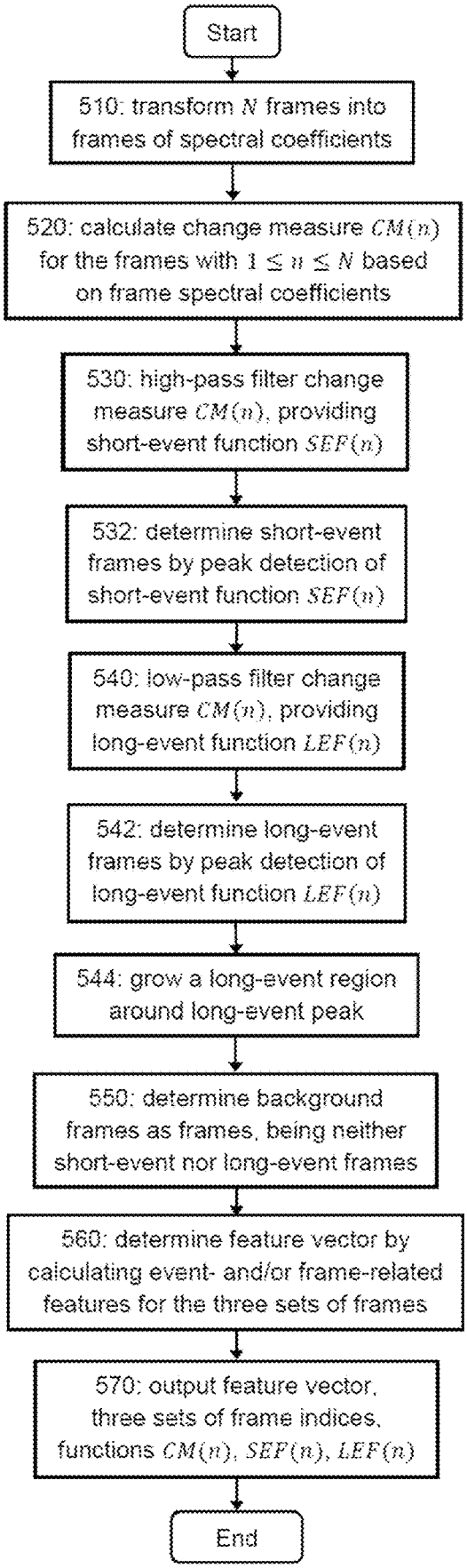
FIG. 5 is a flowchart of an example of segment partitioning of frames into three event layers and the determination of the feature vector, containing the calculated event- and frame-related features based on short-events, long-events, and background.

FIG. 5 shows a flowchart of a method for segmentation of an audio block, which includes grouping the frames of an audio block into the three event classes, according to short event, long events, and background.

An audio block, output by the block segmenter 420, is partitioned in a preceding step into a set of N overlapping frames of equal length, performed e.g. by the framer 430. Alternatively, the partitioning of the audio block may be performed such that the respective frames are non-overlapping.

The first step of the segmentation procedure consists (STEP: 510) in a transformation of each frame to obtain the frame's spectral coefficients, corresponding to the spectrum, respectively, spectrogram. The frame partitioning is accomplished e.g. by multiplying first the lock samples by a windowing function, such as a Hann window function to obtain frame, followed by a discrete Fourier transform (DFT) of the obtained frame. Windowing with a window other than rectangular window ensures that the spectrum obtained by the transformation is limited.

Other windowing functions may be used alternatively, including Hamming, confined Gaussian, Welch, Sine, and the like suitable to perform the windowing as mentioned above.

In order to quantify audio changes within an audio block, a change measure CM (corresponding to a change measure function) is then calculated for the frame (STEP: 520), based on the frame spectra, between the current frame n and at least one of its preceding adjacent frame n' with $n'<n$, and n denoting the frame index. Note that the frame index n corresponds to a discrete time $t_n$, which is used synonymously with the frame index, i.e., $n \equiv t_n$. The change measure function values CM(n) with $1 \le n \le N$ may also be used as a low-level descriptor LLD input to the aggregator 460.

According to an embodiment of the disclosure, the change measure CM is a complex domain difference CDD, in which case two frames preceding frame n are provided to determine the CDD of a frame n.

Based on the change measure CM(n), calculated for the N frames with $1 \le n \le N$, the n-th frame is assigned to one of the three sets of frames related to short-events, long-events, and background. The assignment of a frame into one of the three sets of frames is performed in multiple stages.

Next, the set of short-event frames is determined by high-pass filtering of the change measure values (STEP: 530), represented by the change measure function CM(n). The result of the filtering is the short-event function SEF(n). Similar to CM(n), the SEF(n) may also be used as a low-level descriptor LLD and input to the aggregator 460.

In case of using complex domain difference CDD as the change measure, the high-pass filtering may be implemented by subtracting from the function CDD (n) the result of a (causal) median filter (MedFil{n}) applied to the CDD(n). Since median filter is a low pass filter, after subtracting the low-pass filter part of the CDD from the CDD, the high-pass part remains. Similar filtering may be applied to other change measures. This approach provides for a simple and efficient implementation of the high-pass filtering. It is noted that instead of the median filter, other low-pass filter may be employed.

The set of short-event frames is determined by detecting peaks in the short-event function SEF(n) according to a first predetermined threshold (STEP: 532), and adding the frame corresponding to the detected peak to the set of short-event frames. In other words, a peak may be detected for frame i, if SEF(i) exceeds the first predetermined threshold. The adding of frames into the set of short-event frames may be implemented by storing the index of such frames in association with the short-event category.

According to one embodiment, if the change measure function CM(n) is given by the complex domain difference function CDD (n), the peaks are detected within the high-pass filtered CDD(n). It is noted that the disclosure is not limited to such determination. The peaks may also be directly detected in the CDD and/or any CM used. However, high-pass filtering may lead to a better separation of the high-frequent changes characteristic for the short-term events.

Next, the set of long-event frames is determined by low-pass filtering of the change measure function CM(n) in STEP 540, with the long-event function LEF(n) as output. Similar to the SEF(n), the LEF(n) may also be used as a low-level descriptor LLD and used as input to the aggregator 460.

In case of using complex domain difference CDD as change measure, the low-pass filtering advantageously includes subtracting from the function CDD(n) the corresponding short-event function SEF(n). This means that the set of short-event frames is selectively removed from the set of frames representing the CDD. The result of this operation is then subjected to further filtering by applying the median filter (MedFil{n}), and subsequent application of a moving average filter (MovAvgFil{m}), resulting in the long-event function LEF(n). This filtering is only one of the examples. The present disclosure is not limited thereto. In general, the low-pass filtering may be performed in any other way. For example, the LEF may be obtained by mere subtracting the SEF from the CM or even as the median-filtered CM used to obtain the SEF.

The set of long-event frames is determined by detecting peaks in the low-pas filtered change measure, as represented by the long-event function LEF(n), according to a second predetermined threshold (STEP: 542), and adding the frame corresponding to the detected peak to the set of long-event frames. The peak detection may be performed by detecting local maxima in the LEF(n), e.g. frame indexes which correspond to the respective location of the local maxima of LEF.

Since the long-event frames contain information about the duration of the detected event and, thus, are expected to extend over adjacent frames around each of the detected peaks, the peak detection (STEP: 540) is supplemented by calculating a long-event region (STEP: 544). The respective frames within this region are also included to the set of long-event frames. The calculation of this region around a detected long-event peak (corresponding to a long-event frame) is performed on the basis of the peak height PH of the detected peak, a first and second difference, $g_1$ and $g_2$, between the peak height and a first and second valley within the long-event function LEF(n) (with the first/second valley preceding/following the peak), and a threshold T.

For known peak height PH of the peak (detected in STEP 542) and its two adjacent valleys, respectively, peak-valley differences $g_1$ and $g_2$, the threshold T is first updated according to $T=PH-\min(g_1, g_2)$. Then, using the frame corresponding to the peak as pivot frame, the region is expanded on a frame-basis in both directions from the pivot frame by adding the frame n to the set of long-event frames, until the change measure function CM(n) is lower (or lower-equal) than the threshold T. Finally, frames, which are both long-event and short-event frames, are removed from the set of long-event frames, resulting in the long-event region.

The set of background frames is determined as those frames that are neither short-event frames nor long-event frames (STEP: 550). This does not need to be performed as an explicit step of storing such frames or their indexes but merely by assuming that the frames of which indexes are not associated with long-events or short-events belong to the background layer. In other words, the background frames are the set of frames being the complementary to the union of the set of short-event and long-event frames.

This completes the segmentation process of the frames of one block and includes the three sets of frames (short-event, long-event, background) represented by their corresponding frame indices, the change measure function CM(n), and the short- and long-event function, and possibly SEF(n) and LEF(n), respectively, as low-level descriptors LLDs.

With all N frames of the audio block being grouped into the three event classes on the basis of the calculated audio change measure CM by performing the STEPS 510 to 550, various features can now be computed (STEP: 560) for the individual frames within the three sets of frames and/or using all the frames of one set of frames. Both types of features determine the feature vector, which is output and added to the final feature vector 470.

As indicated above, features may be calculated for either one of the sets of short-event frames, long-event frames, and background frames. In other words, these calculated features are characteristic for the particular event (short, long, or background) occurring within the audio block, defining new event-related features. These event-related features are one part of the feature vector.

Possible event-related features include, for example, event score, event count, activity level, event statistics, and irregularity. For illustration purposes, the activity level is determined by calculating the mean interval between events (i.e., mean frame index interval corresponding to a time interval) occurring within an audio block. From the activity level (mean), the irregularity is accessible directly by calculating the standard deviation of the interval between events. The event-related features are not limited to the above list and may be extended further, depending on the application.

Besides the above event-related features, frame-related features are determined by calculating first for each frame in at least one of the sets of short-event, long-event, and background frames at least one low-level feature, corresponding to a low-level descriptor (LLD), based on the frame's spectrum. These LLD features include, for example, spectral peak, spectral peak frequency, Hammarberg index, alpha ratio, harmonicity, spectral flatness power, spectral centroid, and the like. The LLD feature, calculated for all the frames in one of the three sets of event layers, is then subjected to aggregation. These aggregated features refer to frame-related features, as they have been obtained based on all frames within one of the three frame classes. The aggregation of the LLDs may be performed using the following aggregators, such as mean, median, standard deviation, minimum, maximum, and the like.

These event- and frame-related features, calculated in STEP 560, are merged and determine the feature vector, and provided as output. The step of merging does not have to be performed as a separate step as long as the features to be included into the feature vector are provided (output), for instance, by providing an address in memory in which they are stored or by outputting their values for further use (training, classification, displaying).

In other words, in STEP 570, the results of the segmentation procedure and the feature calculation are provided as output, and the procedure ends. The content of the output includes the feature vector, the three sets of frame indices (short-event, long-event, background), and/or the functions CM(n), SEF(n), and LEF(n) provided as new LLDs to the aggregator 460.

As mentioned before, the additional LLDs output by the segmentation process (STEPS 510 to 570), respectively, by the segment partitioner 440 are used in conjunction with the LLDs, extracted from the original frames (i.e., the non-layer specific frames after the framer 430) by the low-level descriptor extractor 450, as input for the aggregator 460, resulting in frame-related features (block level). The aggregators are the same or similar to the ones used in the segmentation of the frames. These features are combined with the feature vector, determined in STEP 560 and output in STEP 570 (corresponding to the output of the segment partitioner 440), to form the final feature vector 470.

The acoustic scene is then classified based on the feature vector 470, comprising event-related and frame-related features, which have been extracted for each set of short-event, long-event, and background frames, and those features extracted for all frames of the block.

The approach described above provides an improved feature vector 470 by adding new event-related features and, simultaneously, providing event-related low-level descriptors in addition to the extracted LLDs 450, which are exploited for the calculation of frame-related features by aggregation 460. In this way, the stage of the feature extraction, which forms the key building block for both the learning phase (cf. FIG. 1, stage 120) and the classification phase (cf. FIG. 2, stage 220), is improved. Specifically, the learning phase can provide more accurate scene models (140), since the feature extraction 120 uses the enlarged feature vector, including the new event-related features. The classification stage benefits twofold, since it uses the already improved (trained) scene models (as scene model reference) combined with the improved feature vector. These advantages are provided only by performing the segmentation of each frame of an audio block into the three event classes and adding the new LLDs and event-related features to the final feature vector.

The instructions, corresponding to the STEPS 510 to 570 of the method to classify acoustic scenes by extracting a feature vector from a block of audio samples, include partitioning the block into frames; transforming a frame of samples into a respective frame of spectral coefficients; calculating for the frame a change measure between the frame of spectral coefficient and at least one of its preceding adjacent frame; assigning the frame to one of a set of short-event frames, a set of long-event frames, and a set of background frames, based on the respective calculated change measure; and determining and outputting the feature vector based on a feature computed from the set of short-event frames, the set of long-event frames, and the set of background frames are stored on a computer readable medium, which when executed on a processor cause the processor to perform the STEPS of the method.

Figure 6:
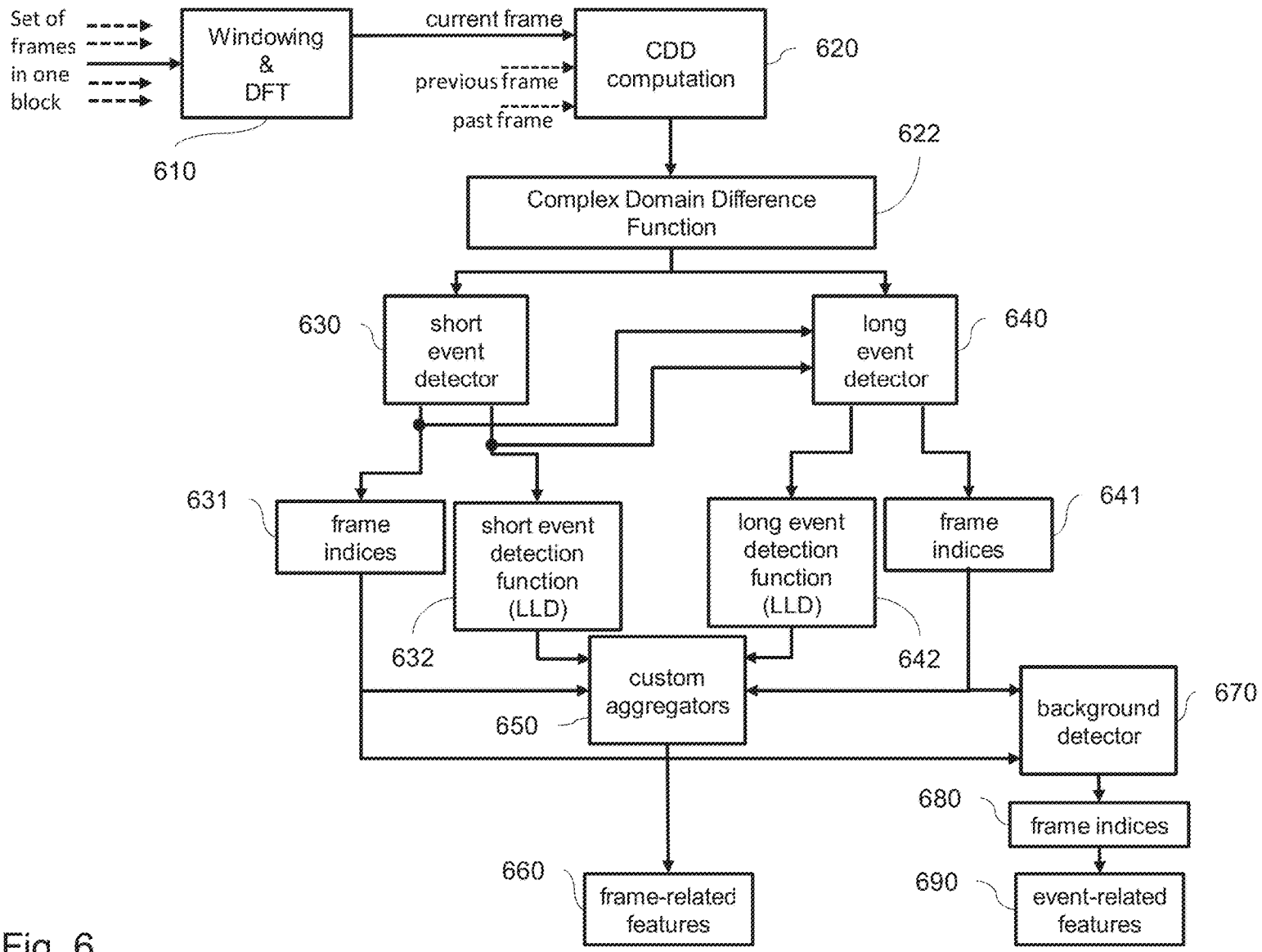
FIG. 6 is a schematic of an example of an apparatus for audio segmentation into the three event layers, exemplified by use of complex domain difference as change measure.

FIG. 6 shows one embodiment for segmentation of an audio signal into three event classes, as demonstrated by example of the complex domain difference (CDD) for the change measure. The schematics of FIG. 6 shows a joint-feature extractor 600, comprising a processing circuitry configured to perform the layer segmentation and layer-based feature extraction of an audio block into three event layers, as discussed in the following.

The set of overlapping frames (N audio samples) of one audio block, corresponding to the output of the framer 430, is input to the windowing & DFT unit 610. The windowing & DFT unit 610 calculates the spectral coefficients (spectrogram) for each frame of the block by multiplying first the frame by an analysis window (windowing) according to a window function, such as a Hann window function.

Other windowing functions may be used alternatively, including Hamming, confined Gaussian, Welch, Sine, and the like suitable to perform the windowing.

Then, the windowed frame is subjected to a discrete Fourier transform (DFT) to obtain a spectral representation of each of the N frames in terms of spectral coefficients (i.e., the spectrum of the frame), corresponding to the spectrogram of the frame. Note that the terms spectral coefficients, spectrogram, and spectrum are used synonymously.

The change measure CM indicating audio changes is then calculated based on the spectrogram of each frame. In the embodiment of FIG. 6, the change measure is based on complex domain difference (CDD), which is calculated by the CDD computation unit 620 for each frame n with frame index $1 \leq n \leq N$. For example, the complex domain difference of the n-th frame CD(n) is calculated, using the current frame n and the two previous (i.e. earlier) frames n−1 and n−2, by $$CD(n) = \sum_{k=-N/2}^{N/2-1} |X(n,k) - X_T(n,k)| \tag{1}$$

$$X_T(n,k) = |X(n-1,k)| e^{\Psi(n-1,k)+\Psi'(n-1,k)} \tag{2}$$

$$\Psi'(n-1,k) = \Psi(n-1,k) - \Psi(n-2,k). \tag{3}$$

The k-th spectral coefficient of the spectrogram for the frame index n is denoted by X(n, k), with k referring to the spectral index (bin) and N the number of frames (audio samples) of one audio block. The CDD 622, calculated according to Eq. (1), results in a complex domain domain difference function CD(n) that evolves for discrete frame times n $t_n$ over the audio block, represented by the N frames.

According to Eq. (1), the CDD is calculated with reference to a target spectrum denoted as $X_T(n, k)$ with $\Psi'(n, k)=\Psi(n, k)-\Psi(n-1, k)$ being the phase difference between the n-th and the previous n−1-th frame with the frequency bin k.

The change measure CM may be calculated alternatively based on spectral flux, phase derivation, correlation, and the like.

The CDD, as calculated according to Eq. (1), accounts for both onset and offset events, i.e., events, whose corresponding audio signatures change by growing and decaying. This means that the CDD based on Eq. (1) captures simultaneously both types of acoustic dynamics without distinguishing them.

In another embodiment, the CDD time function CD(n) can be extended such that separate CDD functions for onset and offset events are calculated, allowing a further diversification of the event-related frames according to onset and offset acoustic signatures. In case of CDD, this can be accomplished by extending Eq. (1) through $$CD(n) = \sum_{k=-N/2}^{N/2-1} |X(n,k) - X_T(n,k)|\theta(|X(n,k)| - |X(n-1,k)|)\text{: onset} \tag{1a}$$

$$CD(n) = \sum_{k=-N/2}^{N/2-1} |X(n,k) - X_T(n,k)|\theta(|X(n-1,k)| - |X(n,k)|)\text{: offset} \tag{1b}$$

where θ denotes the Heaviside theta-function, defined by θ (Y)=1, if Y≥0, and θ(Y)=0 zero otherwise.

The CDD function CD(n) of Eq. (1) is then input to two detector units 630 and 640 to detect short and long events in CD(n). This is accomplished by each of the two units via high-pass (for short events) and low-pass (for long events) filtering of CD(n).

In the embodiment of FIG. 6, the respective filtering units are part of the short and long event detector units 630 and 640, respectively.

Alternatively, the filtering may be performed by external filter units.

The CDD function CD (n) (with the frame index n corresponding to a discrete time index) can then be recast in terms of its high-pass HPF and low-pass LPF filtered components for separating the high-frequency content from the low-frequency parts $$\text{CD}=\text{HPF}\{\text{CD}\}+[\text{CD}-\text{HPF}\{\text{CD}\}]\equiv F_1+F_2 \tag{3}$$

with $F_1$ and $F_2$ referring to two intermediate functions, representing the high-pass and low-pass filtered components of CD(n). Note that the terms CD, CD(n), and CDD are used synonymously, referring to one exemplary realization of the change measure CM in terms of complex domain difference.

According to one implementation of the disclosure, wherein the change measure CM is based on complex domain difference CDD, the high-pass filtering, which in this case is performed before the low-pass filtering, consists in subtraction from the CDD the (causal) median filter (MedFil{*}) of the CDD $$F_1\equiv\text{HPF}\{\text{CDD}\}=\text{CDD}-\text{MedFil}\{\text{CDD}\}. \tag{4}$$

The short-event detection unit 630 detects then the short events by peak picking of the filtered intermediate function $F_1$ (cf. Eq. (4)) on the basis of a first predetermined threshold and returning the corresponding index of the frame, in which the peak is detected. This frame index, respectively, frame is added to the set of short-event frames, as represented by their respective frame indices 631. The resulting set of peak-detected short-event frame indices are used to calculate a short-event detection function SEDF 632, as represented by the set of short-event frames.

According to one implementation of the disclosure, a short-event region may be grown around the detected short-event peak. This option is advantageous, when a sequence of closely spaced short-event peaks is detected, in which case the peak sequence may be merged into a short-event cluster. Based on the detected peak corresponding to a pivot frame, such a short-event region may be built, for example, by adding the following short-event frame n' to the short-event region, whose difference between its frame index n' and the pivot frame n (corresponding to a time interval) is lower than a predetermined threshold.

The calculated output of the short-event detector 630, consisting of the corresponding set of frame indices 631 and detection function 632, along with the CDD 622 are used as input for the long-event detection unit 640, which performs the low-pass filtering and the peak picking to determine the set of long-event frames.

According to one implementation of the disclosure, wherein the change measure CM is based on complex domain difference CDD, the long-event detector 640 performs, with the provided input above, the low-pass filtering by first subtracting the short-event detection function SEDF 632 from the CDD function 622. This means that the set of short-event frames 631 is selectively removed from the set of frames representing the CDD. The long-event detector 640 then performs further the filtering of the intermediate result, referred to as CDD2, by calculating its median providing an intermediate long-event detection function ILEDF:

$$\text{ILEDF}\equiv\text{MedFil}\{\text{CDD2}\}=\text{MedFil}\{\text{CDD}-\text{SEDF}\}. \tag{5}$$

The ILEDF is then subjected to a moving average filter (MovAvgFil{*}), which in the present embodiment is performed twice, resulting in the long-event detection function LEDF 642

$$\text{LEDF}\equiv\text{MovAvg}\{\text{MovAvg}\{\text{ILEDF}\}\}. \tag{6}$$

The long-event frame indices 641 are found by detecting peaks in the long-event detection function LEDF 642, with the respective indices related to the long-event region, entailing information on the duration of each detected long event.

According to one implementation of the disclosure, this is realized by first picking of peaks in the LEDF based on a certain relative peak height with respect to two adjacent valleys and a second predetermined minimum threshold. The relative peak height of the respective valleys, being earlier and later than the detected peak in the LEDF, is determined by the difference between the height of the detected peak PH and two minima of the valleys, referred to as $g_1$ $g_2$. The frame corresponding to the detected peak, refers to a pivot frame inserted to the set of long-event frames, respectively, frame indices 641.

The duration of the long event, which corresponds to a long-event region of the peak, is determined based on the peak height PH of the detected peak, the differences $g_1$ and $g_2$, and a threshold T, with the threshold being updated by $$T=\text{PH}-\min(g_1,g_2). \tag{7}$$

Starting from the actual detected peak, the long-event region is expanded around the peak into the direction of the preceding frames and/or following frames to the peak by adding the respective frame to the set of long-event frames, until the value of the long-event function LEDF is lower than the threshold T. Note that the terms "preceding frames" and "following frames" correspond to frames with frame indices (i.e., discrete time labels), which are earlier (i.e., smaller) and later (i.e., larger) than the frame index n. In other words, starting from the peak frame index, frames with lower indices are compared to the threshold T (by decrementing the frame index by 1 and testing each frame) and included into the long-event region, if their LEDF value exceeds the threshold.

According to one implementation of the disclosure, wherein the LEDF, respectively, change measure CM is based on complex domain difference CDD, the frame is included into the set of long-event frames, until the value of the complex domain difference is lower than the threshold T.

Finally, frames which are both long-event and short-event frames are removed from the set of long-event frames 641, corresponding to the long-event region.

The output frame indices 631 and 641, related to short and long events, are used as input to the background detector 670 to determine the set of background frames, corresponding to background frame indices 680, by removing the sets of short-event frames 631 and long-event frames 641 from the original set of frames of one block. Hence, the set of background frames is the complementary set to the union of the sets of short and long event frames.

Next, using the sets of short-event, long-event, and background frames as input, the event-related feature unit 690 determines event related features by calculating for each set of frames, for example, the counts of the short and the long events.

Another event-related feature may consist of the long-event score by calculating the sum of the peak levels in the long-event detection function, considering only the peaks that were selected by the advanced peak picking method.

Another event-related feature may consists of the short-event score by calculating the sum of the peak levels in the short-event detection function, considering only the peaks above a minimal threshold. Another event-related feature may consist of calculating the variance of the normalized long-event detection function. Another event-related feature may consist of calculating the slope of the normalized long-event detection function, for example, via a least squares linear fit. Another event-related feature may consist of the level of activity and irregularity feature by calculating the mean and standard deviation of the interval between events.

The information provided by the event detection stages are used for defining mid-level features. For example, in the embodiment of FIG. 6, the CDD function 622 and the two event functions 632 and 642 can be employed as additional low-level descriptors and fed to the statistical aggregator block 650 (custom aggregator) to calculate frame-related features 660.

The apparatus described above for implementing the feature extraction and/or scene classification comprises a processing circuitry which in operation performs the event-related partitioning of a sequence of audio blocks. The processing circuitry may be one or more pieces of hardware such as a processor or multiple processors, an application-specific integrated circuit (ASIC) or field programmable gate array (FPGA), or a combination of any of them. The circuitry may be configured to perform the processing described above either by hardware design and/or hardware programming and/or by software programming.

The apparatus may thus be a combination of a software and hardware. For example, the partitioning of the frames into the three audio classes short event, long event, and background, may be implemented as a primary stage to a frame-based classifying unit, performing the joint classification of frame-related and event-related low-level descriptors, for example, or, alternatively may be integrated into it. Such kind of processing may be performed by a chip, such as a general purpose processor, or a digital signal processor (DSP), or a field programmable gate array (FPGA), or the like. However, the present disclosure is not limited to implementation on a programmable hardware. It may be implemented on an application-specific integrated circuit (ASIC) or by a combination of the above mentioned hardware components.

According to an embodiment, the algorithm is implemented in the programming language Python, but may be alternatively realized in any another high-level programming language, including C, C++, Java, C# or the like.

According to one embodiment and example, the feature extraction algorithm is implemented in Python, and consists of two sets of functions that are meant to be executed in successive order.

The present implementation has been tested on a set of audio files with the same length (suggested length is between 5 seconds and 30 seconds), and thus they already represent the actual audio blocks. In this case, the actual implementation does not need to include the first framing stage 420, as shown FIG. 4 in the graphical overview of the overall method.

According to one implementation of the disclosure, the feature extraction on the basis of the three event layers can be further performed in two stages. The first stage performs the low-level feature extraction on a frame basis (using low-level descriptors LLDs) and the segmentation of the audio signal blocks into the three event layers, consisting of short-event, long-event, and background. The result of this procedure may be saved on a storage medium, for example, on a disk containing the result information on the layers and the LLDs. In case of using Python as implementation language, these data are advantageously stored in form of pickle files.

The overall program code may be split into two stages and reads as follows, using as change measure the complex domain difference CDD to quantify the audio changes:

Implementation Stage 1—Program Code Structure Outline

- load audio file into numpy array (scipy.io, numpy)
- partition audio file/block of audio file into frames (same parameters are used for computing the spectrogram)
  - Call Routine→extractFrames( )
- compute spectrogram of each frame (using Python library "librosa")
- perform segmentation of frames based on spectrogram:
  - Call Routine→segmentLayers( ) (including the call of subroutines)
  - compute complex domain difference CDD related to current frame:
  - Call Subroutine→complexDomainDiff( )
  - compute short-event function
  - detect peaks in short-event function and return short-event frame indices:
  - Call Routine→events_peak_picking( ) (basic mode)
  - grow short-event regions around short-event indices
  - compute long-event function
  - detect peaks in long-event function and return long-event region:
  - Call Routine→events_peak_picking( ) (advanced mode)
  - filter out short-event-related frames from long-event region
  - define background region based on the other two detected regions
  - pack obtained layer data in a dictionary and return it
- save layer information on disk (Python pickle format)
- compute spectral features from spectrogram:
- Call Routine→computeSpectralFeatures( )
- compute temporal features from framed audio:
- Call Routine→computeTemporalFeatures( )
- merge information related to spectral and temporal features and save merged layer data LLDs on disk (pickle)

The second set of program scripts reads the files, produced by the first set of scripts/functions, performs the data aggregation based on the results of the layer segmentation, and saves the obtained features in form of pickle files (one per input audio file).

Implementation Stage 2—Program Code Structure Outline:

- load LLD information into a dictionary
- load layer information into a dictionary
- move event detection functions from layer dictionary to LLD dictionary
- compute event-related features from layer data and pack them in a dictionary:
- Call Routine→eventRelatedFeatures( )
  - count long events
  - compute long-event score (sum of the peak levels in the long-event function, considering only the peaks that were selected by the advanced peak picking method)
  - compute variance of the normalized long-event function
  - compute the general slope of the long-event function (least squares linear fit)
  - count short events
  - compute short-event score (sum of the peak levels in the short-event function, considering only the peaks above a minimal threshold)
  - compute level of activity (mean interval between events)
  - compute irregularity feature (standard deviation of the intervals between events)
  - pack obtained features in dictionary and return it
- iterate over LLDs:
  - build 3 arrays from current LLD array, according to 3 layer regions
  - compute statistical functionals over short-event array and append them to output dictionary
  - compute statistical functionals over long-event array and append them to same dictionary
  - compute statistical functionals over background array and append them to same dictionary
- save the output dictionary to disk (in Python format "json")

The above described technique has been evaluated according to its ability of separating acoustic scenes based on a given feature. In the testing, seven exemplary acoustic scenes have been selected, consisting of "home", "train", "subway", "car", "office", "street", and "shop". As features characterizing these acoustic scenes, the LLD features "frequency of the main spectral peak", "spectral difference, "alpha ratio", "energy in the lower part of the spectrum", "first derivative of power function", and "spectral difference" have been chosen, as listed in the first column of Table 1. In addition, each feature is subject to a statistical estimation, based on a certain aggregator for each feature, here consisting of "minimum", "range", "minimum", "maximum", "median", and "standard deviation" (cf. Table 1: second column), calculated over frames of the acoustic scenes. The third column specifies for which layer the respective feature aggregation has been performed. For instance, in the first row, the frequency of the spectral peak of frames belonging to the short-event layer is aggregated by minimum aggregation function meaning that the minimum frequency of the spectral peak among frequencies of the spectral peak for frames belonging to the short-event layer is found.

In one embodiment of the application, the quality of the separability of acoustic scenes has been measured based on the Batthacharyya-distance, which measures the distance between two distributions p(x) and q(x), as given by Eq. (8)

$$\Delta_B(p,q)=-\ln(\Sigma_{x\in X}\sqrt{p(x)q(x)}) \quad (8)$$

with x referring to one specific feature of a set X of features.

The above-mentioned sample features have been extracted from a target data-set, comprising four hours recordings of the seven acoustic scenes.

For each feature, the distributions of values related to different scenes were compared by means of computing the average Batthacharyya distance and the maximum Batthacharyya distance over all possible pairs of classes. These scores were then used to assess the quality of features and the improvement of the layer-based approach with respect to a standard frame-based approach to perform feature extraction.

Table 1 represents the most notable results, obtained when applying the proposed method to a dataset, composed of 4 hours of recorded material from 7 different acoustic scenes mentioned above. For each mid-level feature, the resulting values are normalized, so that the overall distribution has zero mean and unit variance. Then, individual distributions are obtained for each class (audio scene class) and each pair of distributions is compared in terms of the Batthacharyya distance. For each mid-level feature, the average inter-scene distance is computed, as well as the maximum inter-scene distance. The results in Table 1 show the Batthacharyya distance obtained in relation to a specific layer (column 4) and compares it with the distance obtained when computing the statistical aggregator on all the frames of the block (column 5). The difference between the two measures is also reported in the "delta" column of the tables (column 6). The block size used for this experiment is 30 seconds.

TABLE 1

Comparison between layer and frame based calculated Batthacharyya distance for a number of extracted features

| Feature | Aggregator | Layer | Mean distance (layer frames) | Mean distance (all frames) | Delta |
|---|---|---|---|---|---|
| Frequency of the main spectral pak | Minimum | Short Events | 0.681 | 0.035 | 0.646 |
| Spectral difference | Range | Background | 0.847 | 0.303 | 0.543 |
| Alpha ratio | Minimum | Long Events | 1.178 | 0.728 | 0.449 |
| Energy in the lower part of the spectrum | Maximum | Background | 0.671 | 0.234 | 0.437 |
| First derivative of power function | Medium | Background | 1.198 | 0.777 | 0.421 |
| Spectral difference | Std Deviation | Background | 0.848 | 0.429 | 0.419 |

The differences between the frame-based vs. the layer-based approach becomes more apparent by considering error-bar plots for the respective distributions.

Figure 7B:
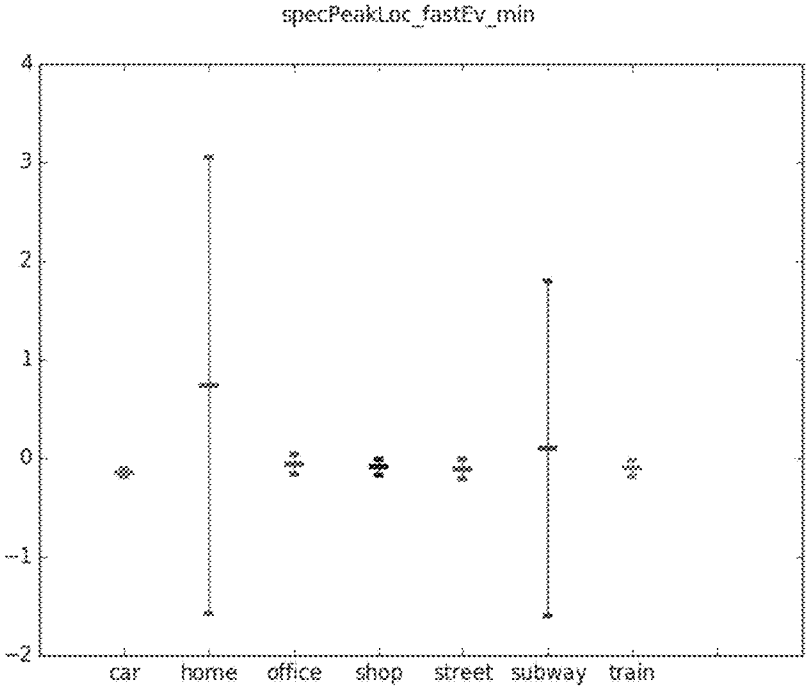
FIG. 7A and FIG. 7B compare the performance of acoustic scene classification based on an event basis versus frame basis for seven sample acoustic scenes.
Figure 7A:
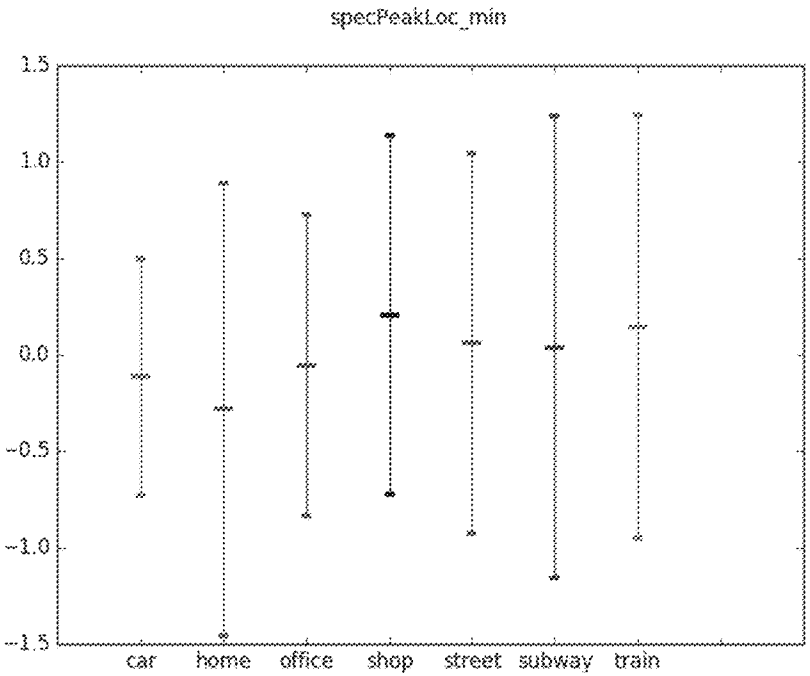

FIG. 7A shows the distribution of one feature (main spectral peak) with the minimum used as aggregator over seven different audio scenes for both frame-based (cf. FIG. 7A) and layer-based (cf. FIG. 7B) calculations.

As explained above, the present disclosure provides methods and apparatuses for implementing the feature vector extraction and/or its use in audio scene classification. The audio scene classification performed automatically delivers results which may be further used to control various other technical processes such as audio coding or decoding, rendering of audio and/or triggering of certain functions or devices.

As described above, the feature vector determination may be implemented as an apparatus, such as a joint-feature extractor 400, as shown in FIG. 4. In particular, the feature extractor 400 may comprise processing circuitries for the segment partitioner 440, the low-level descriptor extractor 450, and the aggregator 460. The feature extractor 400 outputs the feature vector 470 for further processing by the training stage 130 and/or the classification stage 230. The segment partitioner 440, performing the layer segmentation of each frame, may comprise further sub-units, including a transform unit to perform the windowing and DFT (e.g., unit 610), a change measure unit to calculate audio changes on a frame basis (e.g. units 620 and 622), units for short-events (e.g., units 630, 631, 632), long-events (e.g., units 640, 641, 642), and background (e.g. unit 670), along with an output unit (e.g., units 690, 660) to provide parts of the feature vector.

The segment partitioner 440 (including its sub-units), aggregator 460, and low-level descriptor extractor 450 may be part (individually or combined) of an encoder and/or decoder to perform digital processing of audio signals, segmented according to the present disclosure. The encoder and/or decoder may be further implemented in various devices, for example, a TV set, set top box, PC, tablet, smartphone, or the like, i.e., any recording, coding, transcoding, decoding, or playback device. It may be a software or an app implementing the method steps and stored/run on a processor included in an electronic device as those mentioned above.

Such apparatus may be a combination of a software and hardware. For example, the feature vector determination may be performed by a chip such as a general purpose processor, or a digital signal processor (DSP), or a field programmable gate array (FPGA), or the like. However, embodiments are not limited to implementation on a programmable hardware. They may be implemented on an application-specific integrated circuit (ASIC) or by a combination of the above mentioned hardware components.

The feature vector determination may also be implemented by program instructions stored on a computer readable medium. The program, when executed, causes the computer to perform the steps of the above described methods. The computer readable medium can be any medium on which the program is stored such as a DVD, CD, USB (flash) drive, hard disc, server storage available via a network, etc.

Summarizing, the present disclosure relates to an apparatus and method to determine a feature vector to perform classification of acoustic scenes by extracting features from a block of audio samples by partitioning the block into audio frames and calculating a spectrogram for each frame. Based on the spectrograms, audio changes of the block are determined by calculating an audio change function, with the audio changes being used to group the frames into sets of event-related frames according to short events, long events, and background. For each set of frame event-related and frame-related features are calculated and merged into the feature vector. The classification of acoustic scenes is performed based on the feature vector, containing signatures related to audio events occurring within each set of frame, and non-event related features, determined for all frames of the audio block through additional low-level descriptors.

What is claimed is:

1. An apparatus for acoustic scene classification of a block of audio samples, the apparatus comprising:

processing circuitry configured to:

partition the block into frames in the time domain;

calculate, for each respective frame of a plurality of frames of the block, a change measure between the respective frame and a preceding frame of the block;

perform high-pass filtering of the calculated change measures to provide high-pass filtered change measures;

perform low-pass filtering of the calculated change measures to provide low-pass filtered change measures;

assign, based on the respective calculated change measures, the high-pass filtered change measures, and the low-pass filtered change measures, each respective frame to one of a set of short-event frames, a set of long-event frames, or a set of background frames; and determine a feature vector based on a feature computed from one or more of the set of short-event frames, the set of long-event frames, and the set of background frames.

2. The apparatus according to claim 1, wherein the processing circuitry is further configured to:

detect, based on a first predetermined threshold, first peaks in the high-pass filtered change measures, wherein the processing circuitry is configured to assign, to the set of short-event frames, respective frames corresponding to the high-pass filtered change measures having the first peaks.

3. The apparatus according to claim 2, wherein the processing circuitry is further configured to:

detect, based on a second predetermined threshold, second peaks in the low-pass filtered change measures, wherein the processing circuitry is configured to assign, to the set of long-event frames, respective frames corresponding to the low-pass filtered change measures having the second peaks.

4. The apparatus according to claim 3, wherein the processing circuitry is further configured to:

expand the set of long-event frames by adding respective frames corresponding to low-pass filtered change measures having a detected long-event peak corresponding to a long-event region, based on a peak height PH of the detected long-event peak, a first difference $g_1$ between the peak height PH and a first valley in a low-pass filtered change measure preceding the long-event peak, and/or a second difference $g_2$ between the peak height PH and a second valley following the detected long-event peak, and a third threshold T.

5. The apparatus according to claim 4, wherein the processing circuitry is configured to update the third threshold T based on the peak height PH of the detected long-event peak and the minimum of $g_1$ and $g_2$, as follows:

$$T=\mathrm{PH}-\min(g_1,g_2).$$

6. The apparatus according to claim 4, wherein the long-event region is expanded on a frame-basis from the long-event peak in a direction of preceding frames and/or in a direction of following frames, by:

adding a corresponding frame to the set of long-event frames, until a change measure of the frame is lower than the threshold T; and removing the frame from the set of long-event frames corresponding to the long-event region, if the frame is both a long-event frame and a short event frame.

7. The apparatus according to claim 1, wherein the processing circuitry is configured to determine the set of background frames as those frames that are neither short-event frames nor long-event frames.

8. The apparatus according to claim 1, wherein the change measure is a complex domain difference.

9. The apparatus according to claim 1, wherein the feature is calculated according to at least one event-related feature, including event score, event count, activity level, and event statistics.

10. The apparatus according to claim 1, wherein the feature is calculated according to at least one frame-related feature, including spectral coefficients, power, power spectral peak, and harmonicity.

11. The apparatus according to claim 1, wherein the frames of the block are overlapping.

12. The apparatus according to claim 1, wherein transformation of the frame is performed by multiplying the frame by a windowing function and Fourier transform.

13. The apparatus according to claim 1, wherein the acoustic scene is classified based on the feature vector, comprising frame-related features and event-related features extracted for each set of the short-event frames, the long-event frames, and the background frames, and on features extracted for the frames of the block.

14. A method for acoustic scene classification of a block of audio samples, the method including:

partitioning the block into frames in the time domain;

calculating, for each respective frame of a plurality of frames of the block, a change measure between the respective frame and a preceding frame of the block;

performing high-pass filtering of the calculated change measures to provide high-pass filtered change measures;

performing low-pass filtering of the calculated change measures to provide low-pass filtered change measures;

assigning, based on the respective calculated change measures, the high-pass filtered change measures, and the low-pass filtered change measures, each respective frame to one of a set of short-event frames, a set of long-event frames, or a set of background frames; and determining a feature vector based on a feature computed from one or more of the set of short-event frames, the set of long-event frames, and the set of background frames.

15. A non-transitory computer readable medium storing instructions which, when executed on a processor, cause the processor to perform the method according to claim 14.

16. The method according to claim 14, further comprising detecting, based on a first predetermined threshold, first peaks in the high-pass filtered change measures, wherein respective frames corresponding to the high-pass filtered change measures having the first peaks are assigned to the set of short-event frames.

17. The method according to claim 14, further comprising detecting, based on a second predetermined threshold, second peaks in the low-pass filtered change measures, wherein respective frames corresponding to the low-pass filtered change measures having the second peaks are assigned to the set of long-event frames.

* * * * *